US009545184B2

(12) United States Patent
Zhou et al.

(10) Patent No.: US 9,545,184 B2
(45) Date of Patent: Jan. 17, 2017

(54) RICH AIR SPRAYER OF SANITARY WARE

(75) Inventors: Huasong Zhou, Xiamen (CN); Li Jiang, Xiamen (CN); Jianmin Chen, Xiamen (CN); Bin Cao, Xiamen (CN)

(73) Assignees: XIAMEN SOLEX HIGH-TECH INDUSTRIES CO., LTD., Xiamen (CN); Huasong Zhou, Xiamen (CN)

( * ) Notice: Subject to any disclaimer, the term of this patent is extended or adjusted under 35 U.S.C. 154(b) by 766 days.

(21) Appl. No.: 13/812,244

(22) PCT Filed: Aug. 24, 2011

(86) PCT No.: PCT/CN2011/078813

§ 371 (c)(1),
(2), (4) Date: Jan. 25, 2013

(87) PCT Pub. No.: WO2012/025047

PCT Pub. Date: Mar. 1, 2012

(65) Prior Publication Data

US 2013/0118538 A1 May 16, 2013

(30) Foreign Application Priority Data

Aug. 27, 2010 (CN) ..... 2010 1 0266605
Aug. 27, 2010 (CN) ..... 2010 2 0509677 U

(51) Int. Cl.
*A47L 15/42* (2006.01)
*B05B 1/18* (2006.01)
(Continued)

(52) U.S. Cl.
CPC ..... *A47L 15/4278* (2013.01); *B05B 7/0425* (2013.01); *B05B 7/0846* (2013.01); *B05B 1/18* (2013.01)

(58) Field of Classification Search
CPC ..... A47L 15/4278; B05B 1/18; B05B 7/0425; B05B 7/0846
(Continued)

(56) References Cited

U.S. PATENT DOCUMENTS 2,302,021 A † 11/1942 Freeman
2,492,037 A † 12/1949 Freeman
(Continued)

FOREIGN PATENT DOCUMENTS

CN 1326383 A 12/2001
CN 101068622 A 11/2007
(Continued)

*Primary Examiner* — Michael Barr
*Assistant Examiner* — Levon J Shahinian
(74) *Attorney, Agent, or Firm* — Rabin & Berdo, P.C.

(57) ABSTRACT

A rich air sprayer of sanitary ware has a base, the base is disposed with at least two waterways; each waterway includes an inlet hole, a mutation cavity connected to the inlet hole and an air inlet hole connected to the mutation cavity, the flow area of the inlet hole is smaller than that of the mutation cavity, negative pressure is generated inside the mutation cavity when the water flows from the inlet hole into the mutation cavity, the negative pressure makes the mutation cavity suck air from the outside of the sprayer through the air inlet hole, the air and the water are mixed to form bubbles; the outlets of the mutation cavities intersect or the tangents of the outlets of the mutation cavities intersect, making the water flowing out of the outlets of the mutation cavities collide to enhance the granular sensation.

11 Claims, 4 Drawing Sheets

(51) Int. Cl.
*B05B 7/04* (2006.01)
*B05B 7/08* (2006.01)

(58) Field of Classification Search
USPC ..... 134/198; 239/419.5, 428.5, 543
See application file for complete search history.

(56) References Cited

U.S. PATENT DOCUMENTS

| | | | | |
|---|---|---|---|---|
| 3,884,418 | A | | 5/1975 | Ritzenthaler et al. |
| 4,783,008 | A | † | 11/1988 | Ikeuchi |
| 4,991,314 | A | | 2/1991 | Allen |
| 6,029,912 | A | † | 2/2000 | Woolley |
| 2005/0001072 | A1 | † | 1/2005 | Bolus |
| 2007/0001072 | A1 | † | 7/2007 | Taylor |
| 2007/0246577 | A1 | | 10/2007 | Leber |
| 2008/0223957 | A1 | † | 9/2008 | Schorn |

FOREIGN PATENT DOCUMENTS

| | | | |
|---|---|---|---|
| CN | 101080278 | A | 11/2007 |
| CN | 201482611 | U | 5/2010 |
| CN | 101954325 | A | 1/2011 |
| CN | 201791616 | U | 4/2011 |
| JP | 2007056559 | A | 3/2007 |

† cited by third party

RICH AIR SPRAYER OF SANITARY WARE

FIELD OF THE INVENTION

The present invention relates to a rich air sprayer of sanitary ware.

BACKGROUND OF THE INVENTION

There are kinds of showers with different water type, such as the bubble water and shower water. People choose the water type and consider the use characteristic of the water type and the water saving effect. To meet the needs of the user, the applicator applied for a utility model, which is announced in May 26, 2010 in the Chinese patent database namely an outlet mechanism of a sprayer with announcement number CN201482611U. The outlet mechanism of a sprayer is provided with spray water with water saving function, and it is very popular. However, as the spray water is formed from cylindered water and rotation water collision together, the power of the water graininess and the granularity sensation are weak, and the air is weak. So it needs further improvement.

SUMMARY OF THE INVENTION

The present invention is provided with a rich air sprayer of sanitary ware, which overcomes the disadvantages of the existing sprayer. The technical proposal of the present invention to solve the technical problem is as below:

A rich air sprayer of sanitary ware includes a base, the base is disposed with at least two waterways; each waterway includes an inlet hole, a mutation cavity connected to the inlet hole and an air inlet hole connected to the mutation cavity, the flow area of the inlet hole is smaller than that of the mutation cavity, negative pressure is generated inside the mutation cavity when the water flows from the inlet hole into the mutation cavity, the negative pressure makes the mutation cavity suck air from the outside of the sprayer through the air inlet hole, the air and the water are mixed to form bubbles; the outlets of the mutation cavities intersect or the tangents of the outlets of the mutation cavities intersect, making the water flowing out of the outlets of the mutation cavities collide to enhance the granular sensation.

In another preferred embodiment, the inner port of the air inlet hole is disposed in the mutation cavity, the outer port is disposed in the outer surface of the base.

In another preferred embodiment, the outlets of the mutation cavities or the tangents of the outlets of the mutation cavities intersect at a point.

In another preferred embodiment, the intersection angle of the outlets of each two mutation cavities or the tangents of the outlets of each two mutation cavities ranges from 10 degrees to 180 degrees.

In another preferred embodiment, the intersection angle of the outlets of each two mutation cavities or the tangents of the outlets of each two mutation cavities ranges from 20 degrees to 90 degrees.

In another preferred embodiment, the base includes a body and cover; The cover includes a panel and a boss fixed on the central of the bottom surface of the panel, the inlet holes are running through the panel; The body is disposed with a throughout groove inside, the air inlet holes are disposed in the body and running through the throughout groove inside and outside;

The cover is fixed to the body, the boss and the throughout groove are cooperated to form the independent mutation cavities, the mutation cavities are corresponding to the inlet holes one to one, the mutation cavities are corresponding to the air inlet hole one to one.

In another preferred embodiment, a ring is fixed in the lower of the body to surround the throughout groove, the outer port of the air inlet hole is disposed on the bottom surface of the body and outside the ring.

In another preferred embodiment, the point that the tangents of the outlets of the mutation cavities intersecting is disposed inside the ring.

In another preferred embodiment, the boss is cone shaped, the outer revolution surface of the boss is ring disposed with several first grooves, the several first grooves are connected to the several inlet holes one to one; the inner revolution surface of the throughout groove is cone shaped coupled to the boss, the inner revolution surface of the throughout groove is ring disposed with several second grooves; the body is fixed to the cover, the first grooves and the second grooves are coupled to form the mutation cavities.

In another preferred embodiment, the tangents of the outlets of the mutation cavities intersect.

In another preferred embodiment, the inner port of the air inlet hole is disposed in the mutation cavity near the inlet hole.

In another preferred embodiment, a positioning mechanism is disposed between the cover and the body, a raised part is fixed in the lower of the panel of the cover, a position groove corresponding to the raised part is disposed in the body, the raised part and the position groove are relatively positioned.

Compared to the existing technology, the technical proposal of the present invention has advantages as below:

1. The present invention is disposed with several waterways, each waterway is disposed with bubble effect. The water flowing of the several waterways collides so that the air and the water are mixed to form bubbles to enhance the granular sensation and water saving performance, the appearance is beautiful;
2. The tangents of the outlet of the several mutation cavities intersects at a point, preventing the straight flowing intersecting in the outlet to reduce the water flowing power;
3. The intersection angle of the outlets of each two mutation cavities or that of the tangents of the outlets of the cavities is ranged from 10 degrees to 180 degrees with better collision effect;
4. The body and the cover are fixedly connected to from the inlet holes and the mutation cavities, the present invention is simple structure, easy manufacture and easy assembly with small space occupying;
5. The outer port of the air inlet hole is disposed on the bottom surface of the body and outside the ring, making it easier for the base to assemble to the outlet mechanism like a shower.

BRIEF DESCRIPTION OF THE DRAWINGS

The present invention will be further descried with the drawings and the embodiments.

DETAILED DESCRIPTION OF THE EMBODIMENT

Figure 1:
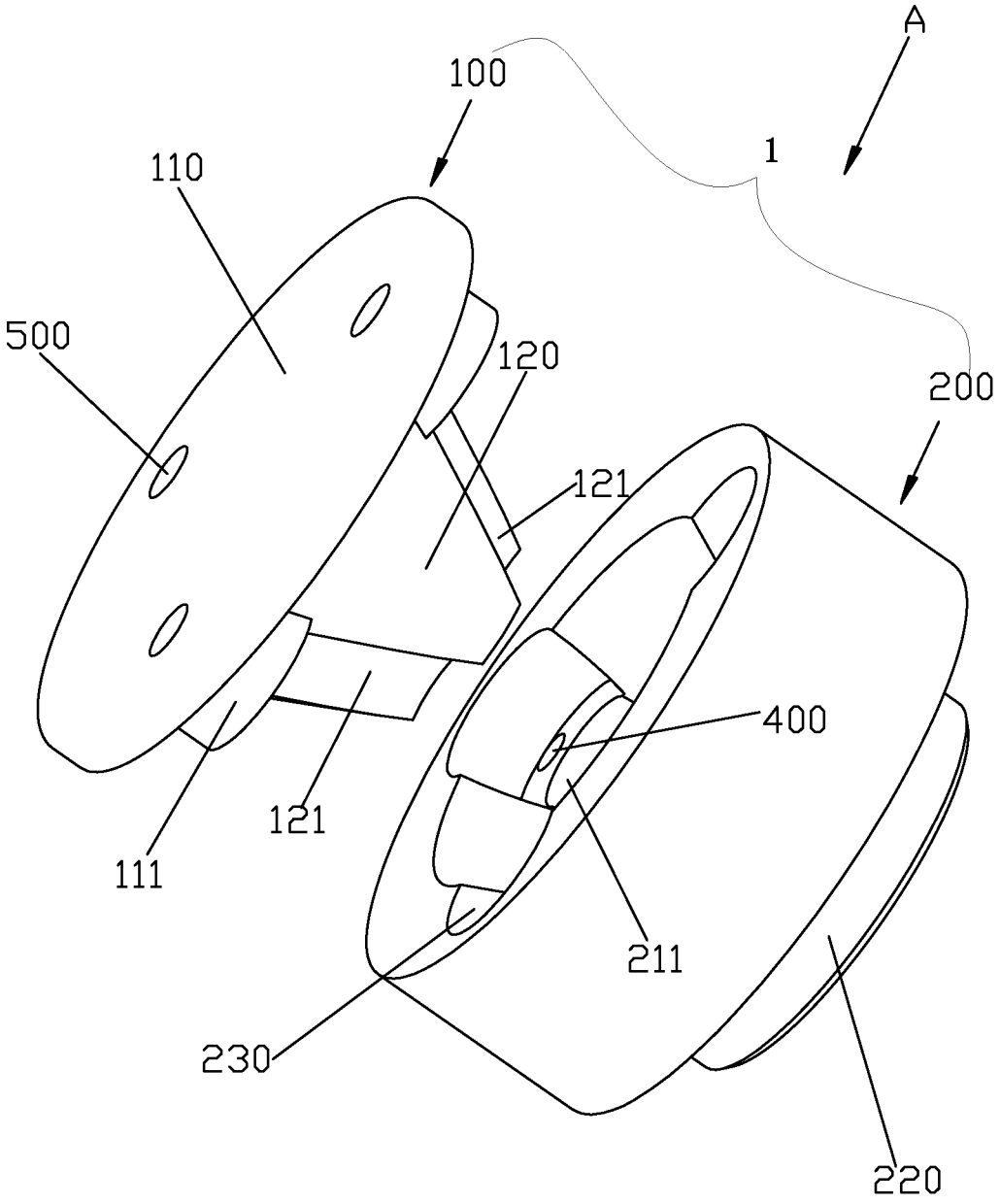
FIG. 1 illustrates the breakdown structure of the sprayer of the present invention.
Figure 2:
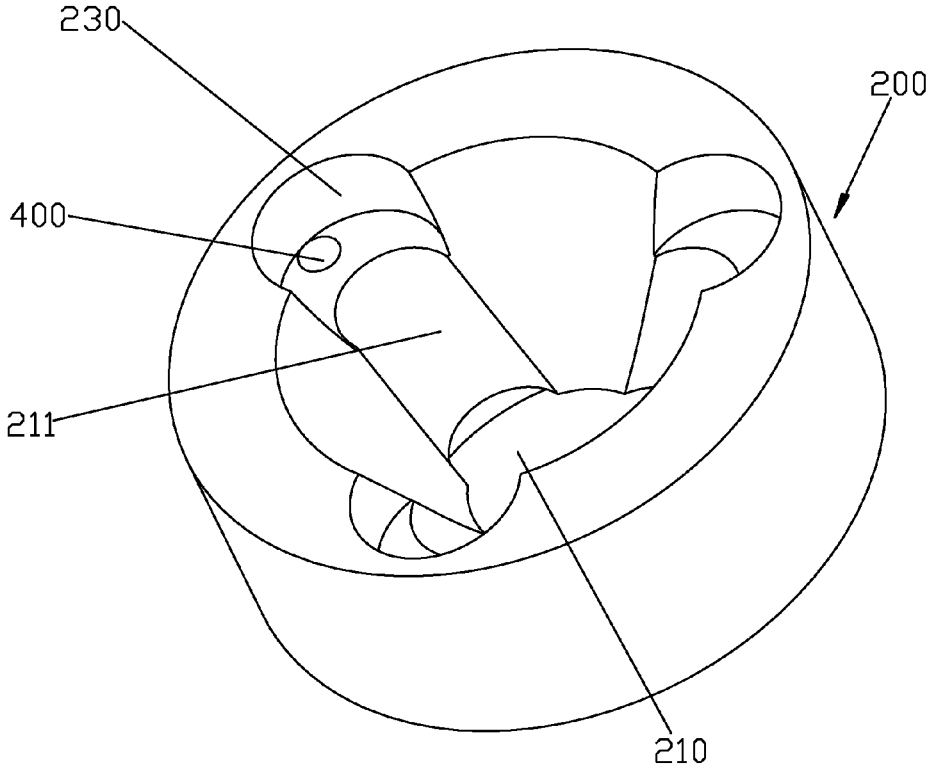
FIG. 2 illustrates the structure of the cover of the sprayer of the present invention.
Figure 3:
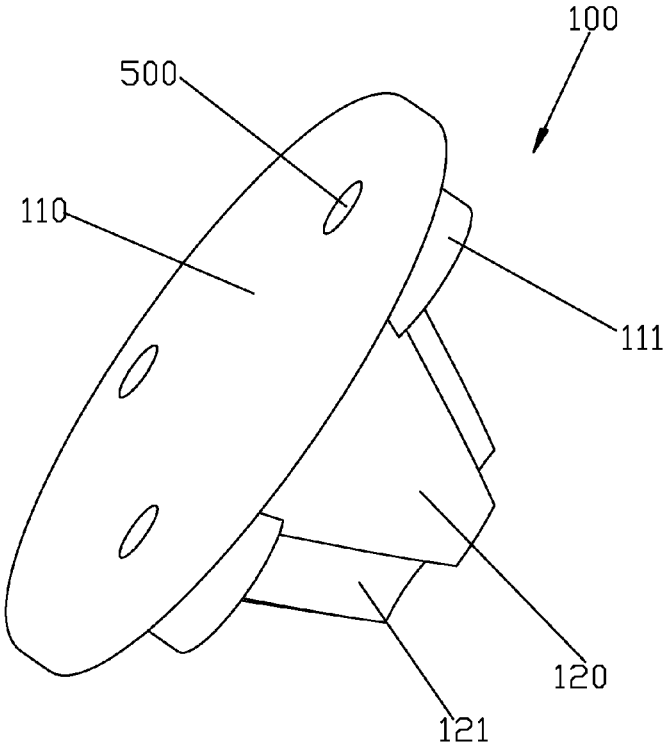
FIG. 3 illustrates the structure of the body of the sprayer of the present invention.
Figure 4:
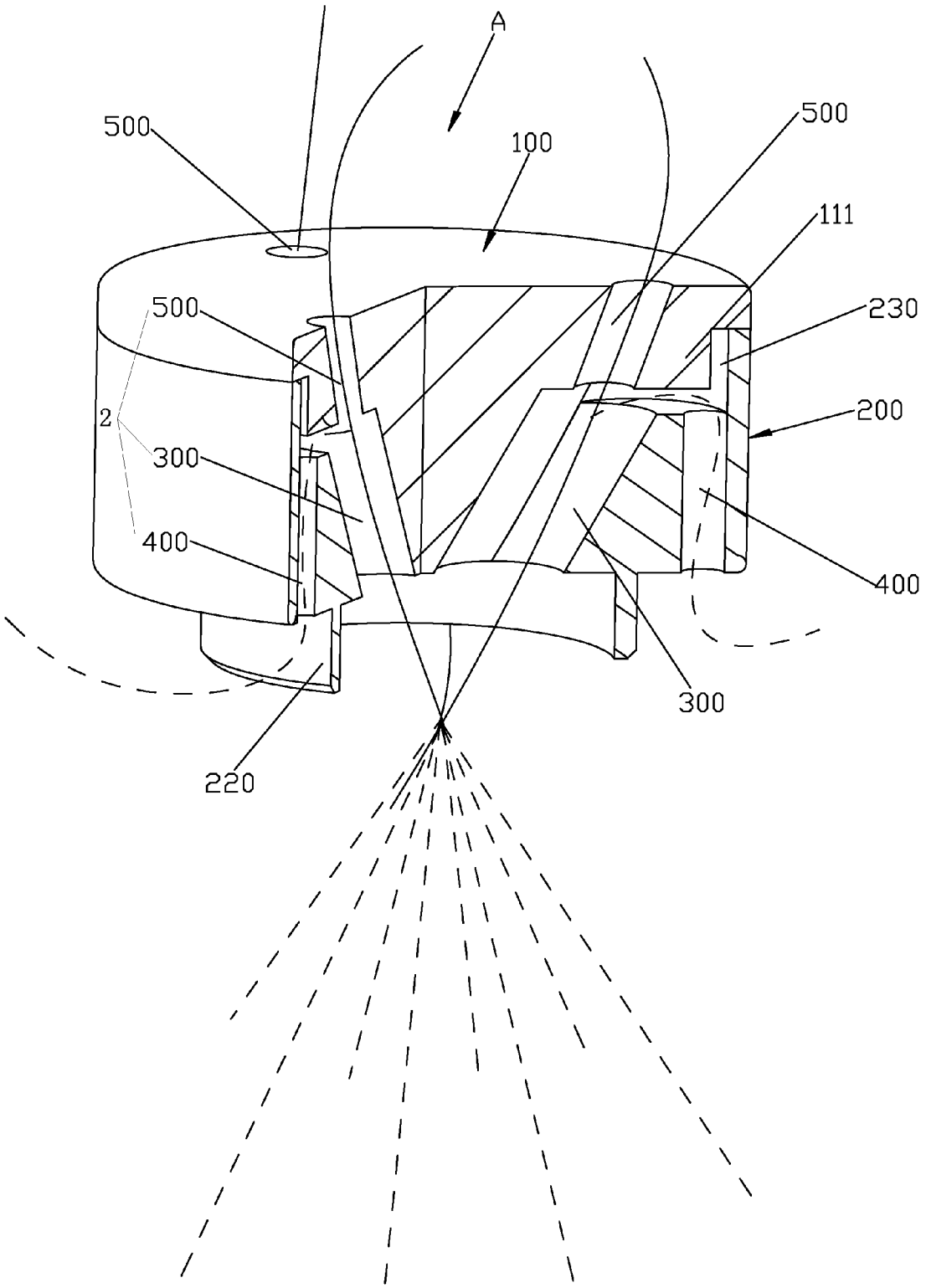
FIG. 4 illustrates the application of the sprayer of the present invention.

Refer to the FIG. 1 to the FIG. 4 of a rich air sprayer of sanitary ware A, which includes a base 1. The base 1 includes a cover 100 and a body 200. The cover 100 includes a panel 110 and a boss 120 in the central of the bottom surface of the panel 110; three inlet holes 500 of throughout up and down and ring arranged are disposed on the panel 110; the boss 120 is cone shaped, and the outer revolution surface of the boss 120 are ring disposed with three first grooves 121, the three first grooves 121 and the inlet holes 500 are one-to-one corresponding and connected.

A throughout groove 210 is disposed inside the body 200, a ring 220 is disposed on the bottom surface of the body 200, the ring 220 is surrounded the lower of the throughout groove 210. The inner revolution surface of the throughout groove 210 is cone shaped coupled to the boss 120. The inner revolution surface of the throughout groove 210 is ring disposed with three second grooves 211. The body is disposed with three air inlet holes 400, which are one-to-one corresponding to the three second groove 211. And the inner port of the air inlet hole 400 is disposed in the second groove 211, the outer port is disposed on the bottom surface of the body 200 and outside the ring 220.

The body 200 is fixed to the cover 110, that: the first groove 121 and the second groove 211 are coupled to form the mutation cavity 300. the three mutation cavities 300 and the three inlet holes 500 are one-to-one corresponding, the three mutation cavities 300 and the three air inlet holes 400 are one-to-one corresponding, one set of the corresponding inlet hole 500, the mutation cavity 300 and the air inlet hole 400 are formed to be a waterway 2, that is to say, the spray of this embodiment is disposed with three independent waterways 2.

Thereinto: the flow area of the inlet hole 500 is smaller than that of the mutation cavity 300, negative pressure generates inside the mutation cavity 300 when the water flows from the inlet hole 500 to the mutation cavity 300. the negative pressure makes the mutation cavity 300 suck air from the outside of the sprayer through the air inlet hole 400, the air and the water are mixed to form bubbles; the intersection angle of the tangents of the outlets of each two mutation cavities 300 is ranged from 10 degrees to 180 degrees, preferred 20 degrees to 90 degrees. The tangents of the outlets of the three mutation cavities 300 intersect at a point, the point is situated inside the ring 220, making the making the water flowing out of the outlets of the mutation cavities 300 collide to enhance the granular sensation.

The inner port of the air inlet hole 400 is disposed in the mutation cavity, preferred near the inlet hole.

To make sure that the cover 100 and the body 200 can be positioned correctly, a positioning mechanism is disposed between the cover 100 and the body 200. For example, a raised part 111 is disposed in the lower of the panel 110 of the cover 100 and a corresponding position groove 230 is disposed in the body 200. The raised part 111 and the position groove 230 are relatively positioned.

Figure 5:
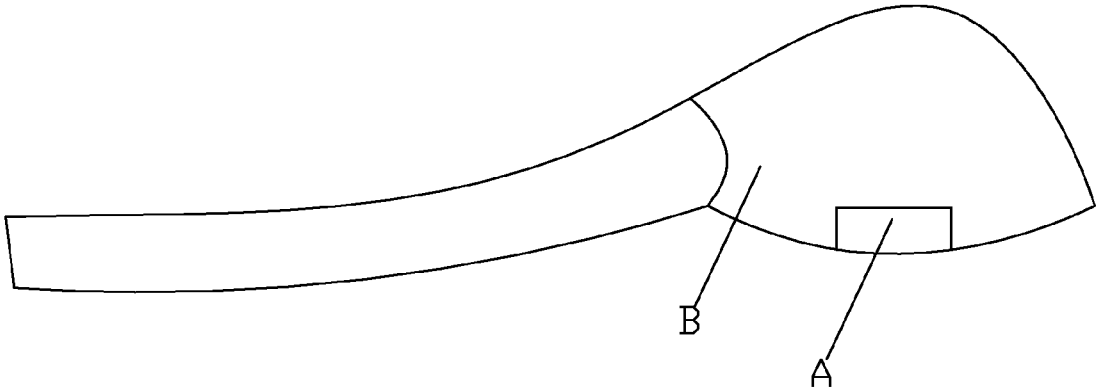
FIG. 5 illustrates an application embodiment of the sprayer of the present invention.

FIG. 5 illustrates a preferred application of this embodiment. The sprayer A is assembled in the outlet cover of a shower B. with the shower of this embodiment, a rich water flowing effect is provided even in a weak flowing status, further enhancing the water saving effect.

Although the present invention has been described with reference to the preferred embodiments thereof for carrying out the patent for invention, it is apparent to those skilled in the art that a variety of modifications and changes may be made without departing from the scope of the patent for invention which is intended to be defined by the appended claims.

INDUSTRIAL APPLICABILITY

The present invention is provided with a rich air sprayer of sanitary ware, which is disposed with waterways. Each waterway is disposed with bubble effect. The water flowing of the waterways collides so that the air and the water are mixed to form bubbles to enhance the granular sensation.

What is claimed is:

1. A rich air sprayer of sanitary ware, wherein
the rich air sprayer includes a base, which is disposed with at least two waterways;
each waterway includes an inlet hole, a mutation cavity connected to communicate directly with the inlet hole, and an air inlet hole connected to the mutation cavity,
a flow area of the inlet hole is smaller than a flow area of the mutation cavity, negative pressure is generated inside the mutation cavity when water flows from the inlet hole into the mutation cavity, the negative pressure makes the mutation cavity suck air from an outside of the sprayer through the air inlet hole, the air and the water are mixed to form bubbles;
outlets of the mutation cavities intersect or tangents of the outlets of the mutation cavities intersect, making the water flowing out of the outlets of the mutation cavities collide to enhance a granular sensation.

2. The rich air sprayer of sanitary ware according to claim 1, wherein
inner ports of the air inlet holes are disposed in the mutation cavities,
an outer port is disposed in an outer surface of the base.

3. The rich air sprayer of sanitary ware according to claim 1, wherein an intersection angle of the outlets of each two mutation cavities or the tangents of the outlets of each two mutation cavities ranges from 10 degrees to 180 degrees.

4. The rich air sprayer of sanitary ware according to claim 3, wherein the intersection angle of the outlets of each two mutation cavities or the tangents of the outlets of each two mutation cavities ranges from 20 degrees to 90 degrees.

5. The rich air sprayer of sanitary ware according to claim 1, wherein the base includes a body and cover;
the cover includes a panel and a boss fixed on the center of a bottom surface of the panel,
the inlet holes are running through the panel;
the body is disposed with a throughout groove inside,
the air inlet holes are disposed in the body and running through the throughout groove inside and outside;
the cover is fixed to the body,
the boss and the throughout groove are cooperated to form the independent mutation cavities,
the mutation cavities are corresponding to the inlet holes one to one,
the mutation cavities are corresponding to the air inlet holes one to one.

6. The rich air sprayer of sanitary ware according to claim 5, wherein
a ring is fixed in a lower part of the body to surround the throughout groove,
outer ports of the air inlet holes are disposed on a bottom surface of the body and outside the ring.

7. The rich air sprayer of sanitary ware according to claim 6, wherein a point that the tangents of the outlets of the mutation cavities intersecting is disposed inside the ring.

8. The rich air sprayer of sanitary ware according to claim 5, wherein the boss is cone shaped, an outer revolution surface of the boss forms a first ring around several first grooves, the several first grooves are connected to the several inlet holes one to one;

an inner revolution surface of the throughout groove is cone shaped coupled to the boss, the inner revolution surface of the throughout groove forms a second ring around several second grooves;

the body is fixed to the cover, the first grooves and the second grooves are coupled to form the mutation cavities.

9. The rich air sprayer of sanitary ware according to claim 5, wherein a positioning mechanism is disposed between the cover and the body, a raised part is fixed in lower part of the panel of the cover, a position groove corresponding to the raised part is disposed in the body, the raised part and the position groove are relatively positioned.

10. The rich air sprayer of sanitary ware according to claim 1, wherein the tangents of the outlets of the mutation cavities intersect.

11. The rich air sprayer of sanitary ware according to claim 1, wherein inner ports of the air inlet holes are disposed in the mutation cavities near the inlet hole.

* * * * *